US006786756B2

(12) United States Patent
Mase et al.

(10) Patent No.: US 6,786,756 B2
(45) Date of Patent: Sep. 7, 2004

(54) CONNECTOR

(75) Inventors: Tsuyoshi Mase, Yokkaichi (JP); Tsutomu Tanaka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/422,040

(22) Filed: Apr. 23, 2003

(65) Prior Publication Data

US 2003/0199206 A1 Oct. 23, 2003

(30) Foreign Application Priority Data

Apr. 23, 2002 (JP) ..... 2002-120578

(51) Int. Cl.[7] ..... H01R 13/62
(52) U.S. Cl. ..... 439/358; 439/271; 439/595
(58) Field of Search ..... 439/358, 357, 439/271, 595

(56) References Cited

U.S. PATENT DOCUMENTS 5,722,857 A 3/1998 Saito et al.
6,126,480 A * 10/2000 Kawase et al. ..... 439/489
6,132,232 A * 10/2000 Okada ..... 439/357
6,179,639 B1 * 1/2001 Kuwahara et al. ..... 439/282
6,186,814 B1 2/2001 Matsushita
6,332,800 B2 12/2001 Kodama
6,579,113 B2 * 6/2003 Kodama ..... 439/358
6,648,699 B1 * 11/2003 Makino et al. ..... 439/752
6,655,971 B2 * 12/2003 Maegawa ..... 439/157
6,659,783 B2 * 12/2003 Copper et al. ..... 439/181
6,666,698 B2 * 12/2003 Beck et al. ..... 439/181

* cited by examiner

*Primary Examiner*—Gary Paumen
(74) *Attorney, Agent, or Firm*—Gerald E. Hespos; Anthony J. Casella

(57) ABSTRACT

A connector has male and female housings (10, 40) that are connectable with one another. A moving plate (30) is movable in the male housing (10) from a first position to a second position during the connection process. A resistance arm (36) on the moving plate (30) must deflect to pass an abutting surface (21) on the male housing (10) during connection, and a lock arm (46) on the female housing (40) must deflect to pass a locking section (25) of the male housing (10) during connection. Resistance forces for deflecting the resistance arm (36) and the lock arm (46) reach peaks substantially simultaneously and before terminal fittings of the housings (10, 40) engage.

20 Claims, 8 Drawing Sheets

CONNECTOR

BACKGROUND OF THE INVENTION

1. Field of the Invention

The invention relates to a connector with a moving member.

2. Description of the Related Art

Japanese Unexamined Utility Model Publication No. 5-12953 discloses a connector with a receptacle that has an opening side and a back side. Tabs project from the back side of the receptacle toward the opening side. The connector also has a moving plate that moves forward and backward from a holding position at the opening side of the receptacle to a position at the back side of the receptacle. The moving plate has positioning holes that engage the tabs. A female housing can be fit into the receptacle and pushes the moving plate to the back side of the receptacle for positioning the tabs with respect to vertical and transverse directions.

Projections are formed on the inner peripheral surface of the receptacle and engage opposite front and rear ends of the moving plate to prevent the moving plate from moving forward and back from the holding position. The moving plate is disengaged from the projections and is moved back in the process of connecting the female housing by giving a connecting force that exceeds the locking forces of the projections.

Connection resistance results from friction acting between terminal fittings and increases in a connector that has a large number of terminal fittings. Accordingly, an inertial locking construction is adopted to connect two housings. The inertial locking construction includes a resistance arm on one housing and an abutment on the other housing. The resistance arm engages the abutment before the connection resistance acts in the process of connecting the two housings to intentionally generate a resistance force larger than the connection resistance between the terminal fittings. Thus, an operation force larger than the resistance force generated by the resistance arm and the abutment must be given to cancel the abutment of the resistance arm. This force exceeds the connection resistance. As a result, the connecting operation of the housings proceeds at a stroke when the resistance by the resistance arm is canceled due to the force given to cancel the resistance, and the two housings advance to a properly connected state.

An inertial locking construction also is applicable to a conventional connector with a moving plate. The resistance arm and the abutment engage when the female housing is fit lightly into the receptacle. A connecting force is given in this state to disengage the resistance arm from the abutment. As a result, the connection of the female housing proceeds at a stroke and the female housing pushes the moving plate.

A difference between the connecting force required to cancel the resistance of the resistance arm and the connection resistance of the terminal fittings should be large to have an effective inertial locking function. However, the projections lock the moving plate at the holding position. The locking by the projections imposes a connection resistance after the cancellation of the resistance by the resistance arm. Thus, the difference between the connecting force required to cancel the resistance of the resistance arm and the connection resistance after the cancellation of the resistance by the resistance arm becomes smaller and the connection of the female housing may be slowed.

The present invention was developed in view of the above problem and an object thereof is to provide a connector having a moving member with a highly reliable inertial locking mechanism.

SUMMARY OF THE INVENTION

The invention relates to a connector with a first housing and at least one terminal fitting in the first housing. A moving member is movable between a first position and a second position relative to the first housing. The connector further includes a second housing connectable with the first housing while directly or indirectly moving the moving member from the first position toward the second position. Inertial locking means are provided in the first and second housings for creating a resistance force against a connecting operation of the two housings and for canceling resistance when a resistance canceling force exceeding the resistance force created by the inertial locking means is applied to the housings. Resistance creating means are provided in the first housing and the moving member for creating a resistance force against a movement of the moving member from the first position toward the second position and for canceling resistance when a resistance canceling force exceeding the resistance force created by the resistance creating means is applied to the housings. The second housing is opposed to the moving member at the first position and hence can push the moving member toward the second position while being held substantially in contact with the moving member. Additionally, the elements of the inertial locking means are held in abutment against each other and the elements of the resistance creating means are held in abutment against each other.

The elements of the resistance creating means abut each other when the moving member is held at the first position and the second housing is connected with the first housing in this state. At this time, the elements of the inertial locking means abut and the second housing is opposed to and substantially in contact with the moving member. A resistance canceling force that exceeds the resistance forces resulting from the abutments of the inertial locking means and the resistance creating means is applied to the two housings in this state. As a result, the inertial locking means and the resistance creating means preferably disengage substantially simultaneously (i.e. within a range of about 10%, preferably 5% of the connection stroke). Accordingly, the connecting operation of the two housings and the movement of the moving member pushed by the second housing to the second position proceed substantially simultaneously in a single stroke. No connection resistance results from the freeing of the moving member from the first position after the inertial locking means and the resistance creating means are disengaged. Thus, the connecting operation of the two housings and the movement of the moving member proceeds smoothly and securely.

The moving member preferably is movable between the first position, where the moving member engages and positions the front ends of the terminal fittings, and the second position, where the moving member engages base ends of the first terminal fittings.

The first housing preferably has a receptacle for at least partly surrounding the terminal fittings. The moving member preferably is accommodated at least partly in the receptacle. Additionally, the second housing preferably is fittable into the receptacle.

A resistance arm preferably is provided on one of the first housing and the moving member and an abutting surface and a fastener for engaging the resistance arm are provided on the other of the first housing and the moving member. The resistance arm and the abutting surface preferably form the resistance creating means, and/or the resistance arm and the fastener preferably form a fastening means for preventing the moving member at the first position from moving loosely out of the receptacle. The construction is simplified because the resistance arm of the resistance creating means also preferably is part of the fastening means.

The moving member preferably comprises a moving plate with terminal holding portions for holding terminal main bodies of the first terminal fittings to prevent loose movements of the terminal main bodies when the moving plate is at the second position. Thus, the moving plate at the second position functions as a front holder, and there is no need for a special front holder. Thus, the number of parts is reduced.

A resistance arm preferably is on one of the first housing and the moving member, and an abutting surface and a lock engageable with the resistance arm are provided on the other of the first housing and the moving member. The resistance arm and the abutting surface preferably are part of the resistance creating means, and the resistance arm and the lock preferably are part of a plate locking means for locking the moving plate at the second position. With this construction, the moving member is locked at the second position and continues to display its function as the front holder even if the second housing is detached. Further, the resistance arm is part of the resistance creating means and part of the plate locking means. Thus, the construction can be simplified.

A peak value of the resistance force of the inertial locking means and of the resistance force of the resistance creating means preferably exceeds a peak value of a connection resistance of the first terminal fittings with second terminal fittings in the second housing.

Peak values of the resistance forces of the inertial locking means and the resistance creating means preferably are reached at an earlier stage of the connection of the two housings than a peak value of a connection resistance of the first and second terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
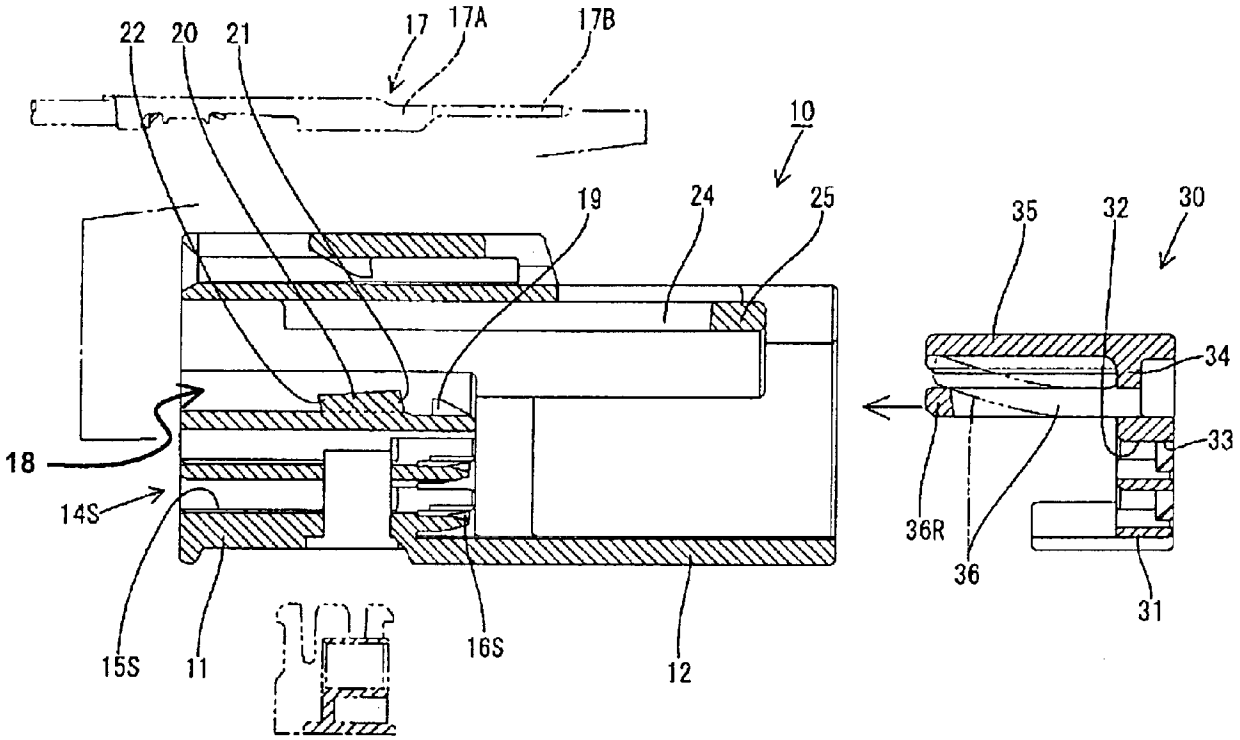
FIG. 1 is an exploded section of a male housing according to one embodiment of the invention.
Figure 2:
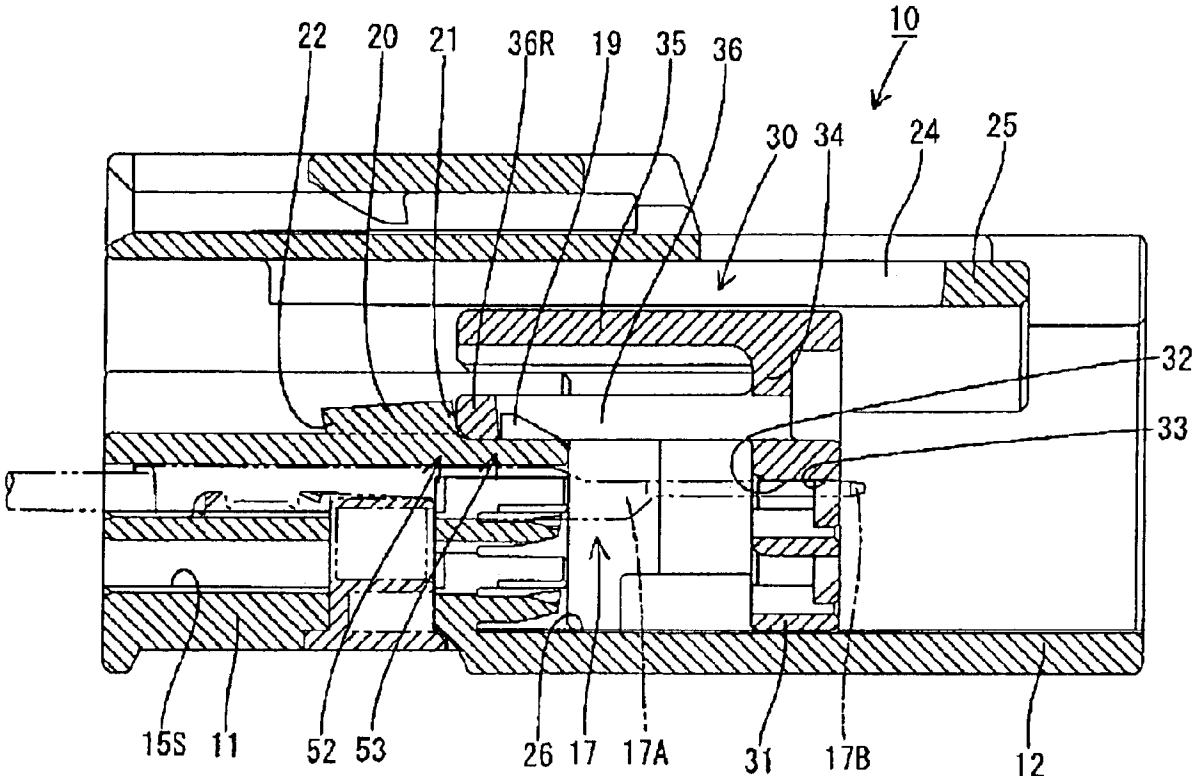
FIG. 2 is a section of the male housing in a state where a front holder is partly locked.
Figure 3:
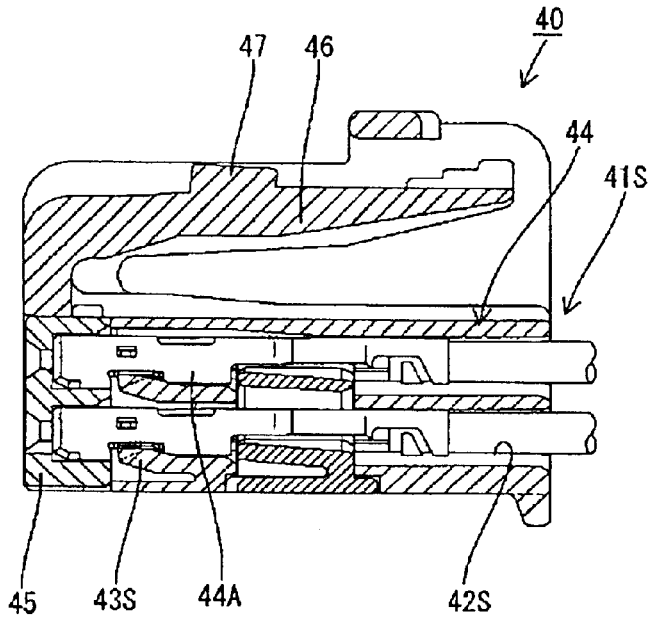
FIG. 3 is a section of a female housing.

A connector according to the invention is illustrated in FIGS. 1 to 10 and includes a male housing 10 and a female housing 40 that can be connected with each other along a connecting direction CD. Mating sides of the housings 10, 40 are referred to as the front in the following description.

The male housing 10 is made e.g. of a synthetic resin, and has a main body 11 in the form of a wide box. A substantially rectangular tubular receptacle 12 projects forward from the outer periphery of the main body 11 and is dimensioned to receive the female housing 40. The main body 11 includes left and right large cavity groups 14L, each of which includes large cavities 15L disposed in a 2×2 arrangement. The main body 11 also includes a small cavity group 14S disposed between the large cavity groups 14L. The small cavity group 14S has a plurality of small cavities 15S arranged transversely at upper and lower stages.

A large male terminal fitting (not shown) is inserted into each large cavity 15L and is locked by a resin lock 16L so that a tab at the front end of the large male terminal fitting projects into the receptacle 12.

A small male terminal fitting 17 is inserted into each small cavity 15S and is locked by a resin lock 16S that engages a terminal main body 17A of the small male terminal fitting 17. The small male terminal fitting 17 is stopped at its front-limit position by locking means (not shown) on a side surface of the terminal main body 17A and a sidewall of the small cavity 15S. A tab 17B extends forward from the terminal main body 17A and projects into the receptacle 12.

The small cavities 15S are cross sectionally smaller than the large cavities 15L. Additionally, the transverse and/or vertical intervals between the smaller cavities 15S are smaller than those between the large cavities 15L. A removal space for a mold (not shown) is formed at the opposite left and right sides of and before the resin lock 16S of each small cavity 15S and enables removal of a mold (not shown) for molding the resin lock 16S. The small cavity 15S is only slightly wider than the resin lock 16S. Thus, areas of the main body 11 at the left and right sides of the resin locks 16S and before the resin lock 16S cannot be formed with means for supporting the front end of the terminal main body 17A of the small male terminal fitting 17.

An escaping hole 18 penetrates the housing main body 11 in forward and backward directions and is right above the narrow cavity group 14S. A fastener 19 and a protrusion 20 are arranged on the upper surface of the housing main body 11 one after the other and are displaced transversely of the escaping hole 18. The fastener 19 is substantially triangular in side view and has a slanted front surface. The protrusion 20 is substantially rectangular in side view. An abutting surface 21 is defined at the front end of the protrusion 20 and a lock surface 22 is defined at the rear end.

The ceiling wall of the escaping hole 18 extends forward, and a slit 24 extends forward and backward at the transverse middle of this extended portion. A locking section 25 is formed at the front end of the slit 24. The front and rear end surfaces of the locking section 25 are aligned substantially normal to a connecting direction CD of the two housings 10, 40.

The connector also includes a moving plate 30 made e.g. of a synthetic resin. The moving plate 30 has a main body 31 in the form of a thick substantially rectangular plate that closely fits into a mounting recess 26 in the front-end surface of the housing main body 11. The moving plate 30 is mounted into the receptacle 12 from the front, and is movable forward and back along the moving direction MD between a holding position (see FIGS. 2 and 4) close to the open front end of the receptacle 12 and a freeing position (see FIG. 5) where the plate main body 31 fits in the mounting recess 26. Moving directions MD of the moving plate 30 are substantially parallel with the connecting direction CD of the two housings 10, 40.

Substantially rectangular terminal holding portions 32 are formed in the rear surface of the plate main body 31 at locations corresponding to the respective smaller cavities 15S, and tab insertion holes 33 extend from the respective terminal holding portions 32 to the front end of the plate main body 31. The tab insertion holes 33 engage the front ends of the corresponding tabs 17B when the moving plate 30 is at the holding position, and hence position the tabs 17B with respect to vertical and transverse directions. The tab insertion holes 33 engage the base ends of the tabs 17B when the moving plate 30 is at the freeing position. Additionally, the terminal holding portions 32 engage the front ends of the terminal main bodies 17A and form the front ends of the smaller cavities 15S when the moving plate 30 is at the freeing position. This engagement positions the front ends of the terminal main bodies 17A vertically and transversely. Thus, the moving plate 30 functions as a front holder while located at the freeing position.

Figure 7:
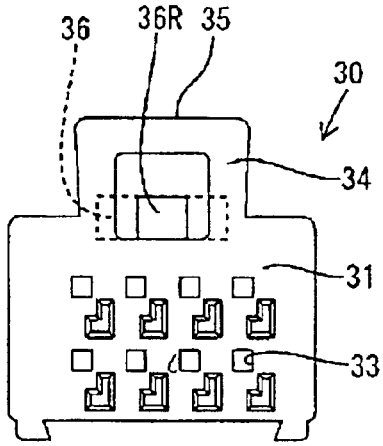
FIG. 7 is a front view of a front holder.
Figure 8:
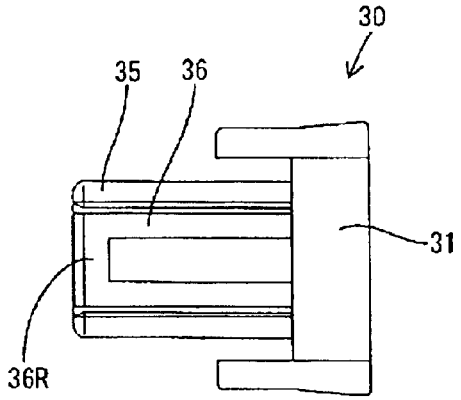
FIG. 8 is a bottom view of the front holder.
Figure 9:
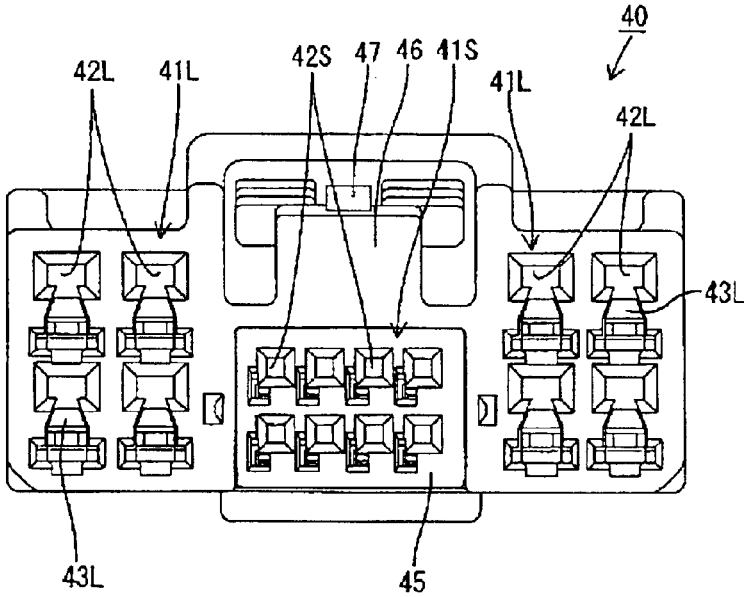
FIG. 9 is a front view of the female housing.
Figure 10:
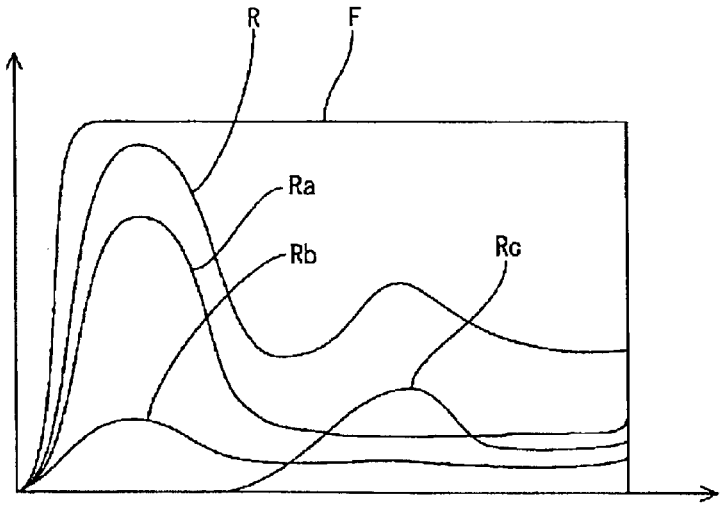
FIG. 10 is a graph showing a variation of a resistance canceling force of inertial locking and variations of the respective connection resistances in the process of connecting the two housings.

A bulge 34 extends up substantially from a transverse middle of the upper end of the plate main body 31, and has a trapezoidal shape when viewed from the front (FIG. 7). A protection plate 35 projects back from the upper end of the bulge. Further, a resistance arm 36 cantilevers back at a position on the bulge 34 below the protection plate 35 and is vertically resiliently deformable. An extending rear end 36R of the resistance arm 36 has a surface aligned substantially normal to the moving directions MD of the moving plate 30 and is engageable with the fastener 19 and the protrusion 20.

The resistance arm 36 and the abutting surface 21 comprise a resistance creating means 52 (see FIGS. 2 and 4) for preventing the moving plate 30 from moving from the holding position toward the freeing position. The resistance arm 36 and the fastener 19 comprise a fastening means 53 (see FIGS. 2 and 4) for preventing the moving plate 30 from moving loosely from the holding position toward the opening of the receptacle 12. Further, the resistance arm 36 and the locking surface 22 comprise a plate locking means 54 (see FIG. 5) for locking the moving plate 30 at the freeing position.

The resistance arm 36 extends substantially along the lower surface of the protection plate 35, and projects from the bulge 34 substantially by the same distance as the protection plate 35. Additionally, the resistance arm 36 is narrower than the protection plate 35. These shapes and dimensions ensure that the protection plate 35 protects the resistance arm 36 when the moving plate 30 is detached from the male housing 10. Further, as shown by phantom line in FIG. 1, the resistance arm 36 contacts the lower surface of the protecting plate 35 when resiliently deformed up to a specified degree, and hence is prevented from deforming beyond its resiliency limit.

The female housing 40 is made e.g. of a synthetic resin and defines a substantially rectangular block that can fit into the receptacle 12 of the male housing 10. Large and small cavity groups 41L, 41S are formed inside the female housing 40 and correspond to the wide and narrow cavity groups 14L, 14S of the male housing 10. Large female terminal fittings (not shown) are inserted respectively into the large cavities 42L of the large cavity groups 41L and are locked by resin locks 43L. Similarly, small female terminal fittings 44 are inserted into the small cavities 42S of the small cavity group 41S and are locked by resin locks 43S that engage with substantially rectangular tubes 44A of the small female terminal fittings 44. Each small female terminal fitting 44 is stopped at its front-limit position by locking means (not shown) provided on a side surface of the substantially rectangular tube portion 44A and a sidewall of the respective small cavity 42S.

The female housing 40 has space restrictions similar to the male housing 10 and has no integral support the front ends of the rectangular tubes 44A of the small female terminal fittings 44. Thus, a front holder 45 positions the front ends of the rectangular tubes 44A with respect to vertical and transverse directions. The front holder 45 is similar to the plate main body 31 of the moving plate 30, and hence no detailed description is given.

A lock arm 46 extends up and back from the front end of the upper surface of the female housing 40 and is resiliently deformable up and down. A lock projection 47 is formed on the upper surface of the lock arm 46, and the front and rear end surfaces of the lock projection 47 are aligned substantially normal to the connecting direction CD of the housings 10, 40. The lock arm 46 and the locking section 25 comprise the inertial locking means 51 for locking the two housings 10, 40 in their properly connected state.

The two housings 10, 40 are connected along the connecting direction CD by first mounting the moving plate 30 at the holding position in the receptacle 12 of in the male housing 10. The posture of the moving plate 30 is stabilized during the mounting process by sliding the protection 35 in contact with the ceiling wall of the receptacle 12. The resistance arm 36 is deformed resiliently up immediately before the holding position. As a result, the extending end 36R of the resistance arm 36 moves onto the fastener 19. The extending end 36R of the resistance arm 36 engages the fastener 19 from behind when the holding position is reached and prevents the moving plate 30 from coming out forward toward the opening side. Additionally, the extending end 36R substantially abuts against the abutting surface 21 from the front to prevent the moving plate 30 from moving loosely toward the freeing position. As a result, the moving plate 30 is located at the holding position.

The male terminal fittings 17 then are inserted into the large and small cavities 15L, 15S. As a result, the front ends of the tabs 17B of the small male terminal fittings 17 fit into the tab insertion holes 33 of the moving plate 30. Thus, the tabs 17B are positioned vertically and/or transversely.

The female terminal fittings 44 are inserted into the cavities 42L, 42S of the female housing 40 in the same manner as in the male housing 10 and the front holder 45 is mounted to hold the rectangular tubes 44A of the female terminal fittings 44.

Figure 4:
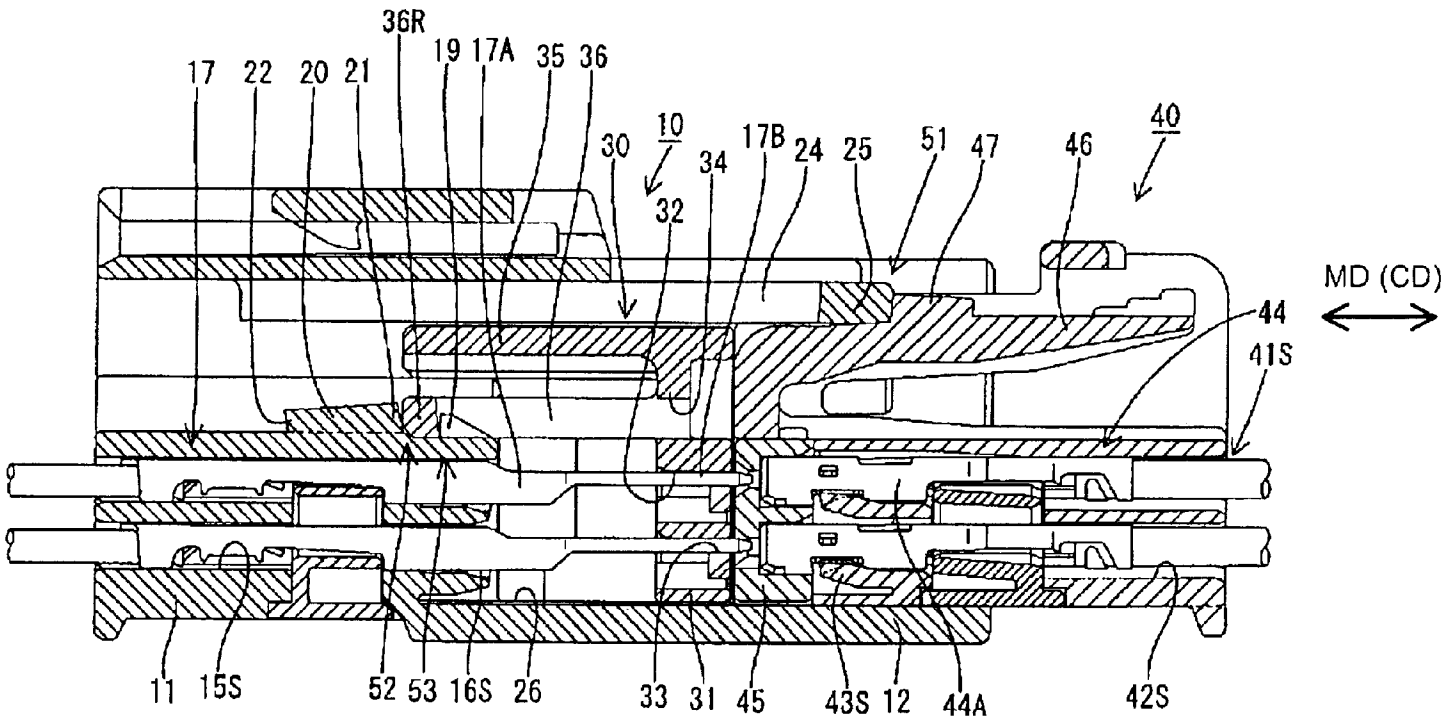
FIG. 4 is a section showing a state where the two housings are partly connected.

The female housing 40 is fit lightly to the connection starting position in the receptacle 12 (see FIG. 4). Thus, the front-end surface of the female housing 40 is held substantially in contact with the front surface of the plate main body 31 of the moving plate 30. However, the front-end surface of the female housing 40 may be spaced slightly from the moving plate 30. In this state, the lock projection 47 of the lock arm 46 substantially abuts against the locking section 25 of the male housing 10 from the front.

The female housing 40 next is pushed to the backside of the receptacle 12 along the connecting direction CD. As a result, the two housings 10, 40 are connected and the moving plate 30 is pushed by the female housing 40 along the moving direction MD from the holding position to the freeing position. The operations of the two housings 10, 40 and the moving plate 30 are described with reference to a graph of FIG. 10. In this graph, the horizontal axis represents a connection stroke of the two housings 10, 40 along the connecting direction CD from the connection starting position to a properly connected position and the vertical axis represents connection resistance against the connecting operation of the two housings 10, 40, a resistance force Ra of the inertial locking means 51, and a resistance force Rb of the resistance creating means 52.

The resistance force Rb is created during the connection process by the resistance creating means 52 due to the abutment of the resistance arm 36 and the abutting surface 21. Additionally, the resistance force Ra is created by the inertial locking means 51 due to the abutment of the lock arm 46 and the locking section 25 immediately after the start of the connecting operation and when the connector housing 40 is close to the connecting starting position (see FIG. 4). Accordingly, a resistance canceling force F exceeding a sum of the resistance force Ra created by the inertial locking means 51 and the resistance force Rb created by the resistance creating means 52 must be given to the two housings 10, 40. That is a resistance canceling force F must be given to the two housings 10, 40 to deform the resistance arm 36 out of engagement with the abutting surface 21 and to deform the lock arm 46 out of engagement with the locking section 25. The contacting surfaces of the resistance arm 36 and the abutting surface 21 and the contacting surfaces of the lock arm 46 and the locking section 25 are substantially normal to the connecting direction CD of the two housings 10, 40. Thus, the resistance canceling force F is considerably large and exceeds the connection resistance Rc resulting from friction between the male terminal fittings 17 and the female terminal fittings 44.

The abutment of the inertial locking means 51 and the abutment of the resistance creating means 52 are canceled substantially simultaneously to reduce the resistance forces Ra, Rb suddenly when the resistance canceling force F is applied to the housings 10, 40. In other words, the peaks of the resistance forces Ra and Rb are reached very close to each other with respect to the connection stroke of the two housings 10, 40. Thus, the resistance canceling force F acts as a driving force for continuing the connection of the two housings 10, 40 and the movement of the moving plate 30 to the freeing position in a single stroke. Accordingly, the two housings 10, 40 reach their properly connected state in a single a stroke and the moving plate 30 is pushed to the freeing position. Both the resistance force Ra created by the inertial locking means 51 and the resistance force Rb created by the resistance creating means 52 have low values after their peaks, and keep the low values until the two housings 10, 40 are connected properly. This results from the sliding contact of the lower surface of the extending end 36R of the resistance arm 36 on the upper surface of the protrusion 20 and the sliding contact of the upper surface of the lock projection 47 on the lower surface of the locking section 25.

The connection resistance Rc resulting from the sliding contact of the tabs 17B of the male terminal fittings 17 and the female terminal fittings 44 is created after the resistances by the inertial locking means 51 and the resistance creating means 52 are canceled and continues until the two housings 10, 40 are connected properly. This connection resistance Rc has a maximum value at an initial stage of the sliding contact of the terminal fittings 17, 44 and then takes low values until the connecting operation is completed.

A value of total connection resistance R (see the graph of FIG. 10) which is a sum of the resistance force Ra created by the inertial locking means 51, the resistance force Rb created by the resistance creating means 52 and the connection resistance Rc created by the terminal fittings 17, 44 is momentarily at its maximum when the abutments of the inertial locking means 51 and the resistance creating means 52 are canceled and, thereafter, suddenly decreases. Accordingly, a difference between the total connection resistance R and the resistance canceling force F is kept large. Thus, an inertial locking function by the inertial locking means 51 and the resistance creating means 52 to continue the connecting operation of the two housings 10, 40 and the movement of the moving plate 30 in a single continuous stroke can be displayed with high reliability by applying the resistance canceling force F.

As described above, the connecting operation of the two housings 10, 40 and the movement of the moving plate 30 pushed by the female housing 40 to the freeing position proceeds substantially simultaneously in a single stroke upon the substantially simultaneous cancellation of the abutments of the inertial locking means 51 and the resistance creating means 52. Thus, after the abutments of the inertial locking means 51 and the resistance creating means 52 are canceled, the connecting operation of the two housings 10, 40 and the movement of the moving plate 30 can proceed smoothly and securely without creating connection resistance due to the freeing of the moving plate 30 from the holding position.

The fastening means 53 formed by the engagement of the resistance arm 36 and the fastener 19 holds the moving plate 30 at the holding position. Thus, the moving plate 30 is prevented from coming out of the receptacle 12. Further, the resistance arm 36 that forms the resistance creating means 52 also serves as the fastening means 53, and hence the construction is simplified.

The terminal holding portions 32 hold the terminal main bodies 17A of the male terminal fittings 17 after the moving plate 30 is moved to the freeing position and thus function as a front holder for positioning the smaller terminal fittings 17 vertically. Accordingly, a special front holder is not required and the number of parts can be reduced. Further, even with the female housing 40 detached, the moving plate 30 is locked at the freeing position by the plate locking means 54 formed by the engagement of the extending end 36R of the resistance arm 36 and the locking surface 22. Thus, the function of the moving plate 30 as a front holder can be kept. The construction is simplified further because the resistance arm 36 functions as part of both the resistance creating means 52 and the plate locking means 54.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The resistance arm of the resistance creating means is in the moving plate and the abutment thereof is in the male housing in the foregoing embodiment. However, the resistance arm may be in the male housing and the abutment may be in the moving plate according to the present invention.

The resistance arm of the resistance creating means also is the fastening means in the foregoing embodiment. However, a fastening arm may be separate from the resistance arm.

The resistance arm of the fastening means is in the moving plate and the fastening portion is in the male housing in the foregoing embodiment. However, the resistance arm may be in the male housing and the fastening portion may be in the moving plate according to the present invention.

The resistance arm of the plate locking means is in the moving plate and the lock is in the male housing in the foregoing embodiment. However, the resistance arm may be in the male housing and the lock may be in the moving plate according to the present invention.

The front end of one mounting member functions as the abutment and the rear end thereof functions as the lock in the foregoing embodiment. However, the abutment and the lock may be independent of each other.

The resiliently deformable resistance arm and the fixed abutment form the resistance creating means in the foregoing embodiment. However, the resistance creating means may comprise two or more resistance arms.

The lock arm and the locking section for locking the housings in their properly connected state also serve as the inertial locking means in the foregoing embodiment. However, an inertial locking means may be separate from the lock arm and the locking section so that the lock arm and the locking section function only as the locking means for the two housings.

The lock arm is in the female housing and the locking section is in the male housing in the foregoing embodiment. However, the lock arm may be in the male housing and the locking section may be in the female housing.

The moving plate is the front holder in the foregoing embodiment. However, a front holder separate from the moving plate may be provided.

The front holder for holding the terminal main bodies of the male terminal fittings also is the moving plate in the foregoing embodiment. However, the front holder may not be provided in present invention.

The moving plate has been described as moving along the moving direction MD substantially parallel to the connecting direction CD of the connector housings. However, the moving plate may move in a direction aligned at an angle to the connecting direction CD.

The female housing directly contacts the movable plate. However the female housing may indirectly move the movable plate 30 e.g. by interposing some other element.

What is claimed is:

1. A connector, comprising:

a first housing (10) with terminal fittings (17);

a moving member (30) movable between a first position (FIGS. 2; 4) and a second position (FIG. 5) relative to the first housing (10);

a second housing (40) connectable with the first housing (10) while moving the moving member (30) at the first position toward the second position;

inertial locking means (51) in the first and second housings (10, 40) for creating a resistance force (Ra) against a connecting operation of the housings (10, 40) by abutting against each other during connection of the two housings (10, 40) and for canceling resistance by disengaging from each other when a resistance canceling force (F) exceeding the resistance force (Ra) created by the inertial locking means (51) is given; and resistance creating means (52) in the first housing (10) and the moving member (30) for abutting against each other to create a resistance force (Rb) against a movement of the moving member (30) toward the second position with the moving member (30) located at the first position and for canceling resistance by disengaging from each other when a resistance canceling force (F) exceeding the resistance force (Rb) created by the resistance creating means (52) is given;

wherein the second housing (40) is opposed to the moving member (30) at the first position for pushing the moving member (30) toward the second position while being held substantially in contact with the moving member (30) with the inertial locking means (51) held in abutment against each other and the resistance creating means (52) held in abutment against each other.

2. The connector of claim 1, wherein the moving member (30) in the first position (FIGS. 2; 4) engages and positions front ends of the terminal fittings (17), and the movable member (30) in the second position (FIG. 5) engages base ends of the terminal fittings (17).

3. The connector of claim 1, wherein the first housing (10) has a receptacle (12) for at least partly surrounding the terminal fittings (17).

4. The connector of claim 3, wherein the moving member (30) is at least partly accommodated into the receptacle (12).

5. The connector of claim 4, wherein the second housing (40) is at least partly fittable into the receptacle (12).

6. The connector of claim 1, wherein the resistance creating means (52) comprises a resistance arm (36) in one of the first housing (10) and the moving member (30) and an abutting surface (21) on the other of the moving member (30) and the first housing (10).

7. The connector of claim 6, wherein the resistance arm (36) is on the moving member (30) and the abutting surface (21) is on the first housing (10).

8. The connector of claim 7, further comprising a fastening means (53) for preventing the moving member (30) at the first position from moving loosely of the first housing (10).

9. The connector of claim 8, wherein the fastening means (53) comprises a fastener (19) formed on the first housing (10) and the resistance arm (36).

10. The connector of claim 1, wherein the moving member (30) comprises a moving plate (30) formed with terminal holders (32) for holding terminal main bodies (17A) of the terminal fittings (17) to prevent loose movements of the terminal main bodies (17A) by engaging the terminal main bodies (17A) when the moving plate is at the second position.

11. The connector of claim 1, wherein the resistance creating means (52) comprises a resistance arm (36) in the moving plate (30) and a protrusion (20) with an abutting surface (21) in the first housing (10) for engaging the resistance arm (36).

12. The connector of claim 11, wherein the protrusion (20) has a locking surface (22) for engaging the resistance arm (36) to form a plate locking means (54) for locking the moving plate (30) at the second position.

13. The connector of claim 1, wherein a sum of the peak value of the resistance force (Ra) of the inertial locking means (51) and the resistance force (Rb) of the resistance creating means (52) is greater than a peak value of a connection resistance (Rc) of the terminal fittings (17) with mating terminal fittings (44) in the second housing (40).

14. The connector of claim 1, wherein a peak value of the resistance force (Ra) of the inertial locking means (51) and of the resistance force (Rb) of the resistance creating means (52) is reached at an earlier stage of the connection of the two housings (10, 40) than a peak value of a connection resistance (Rc) of the terminal fittings (17) with the mating terminal fittings (44) provided in the second housing (40).

Figure 5:
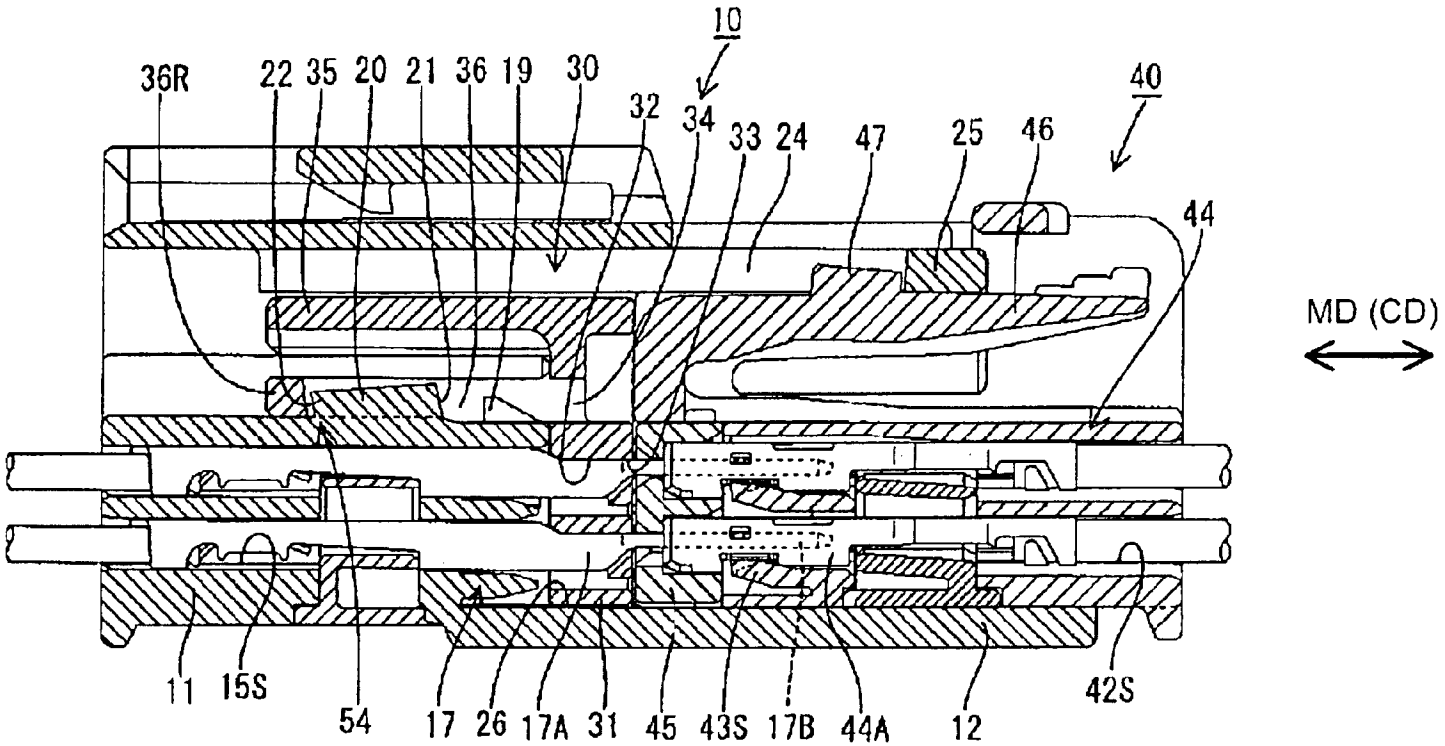
FIG. 5 is a section showing a state where the two housings are fully connected.
Figure 6:
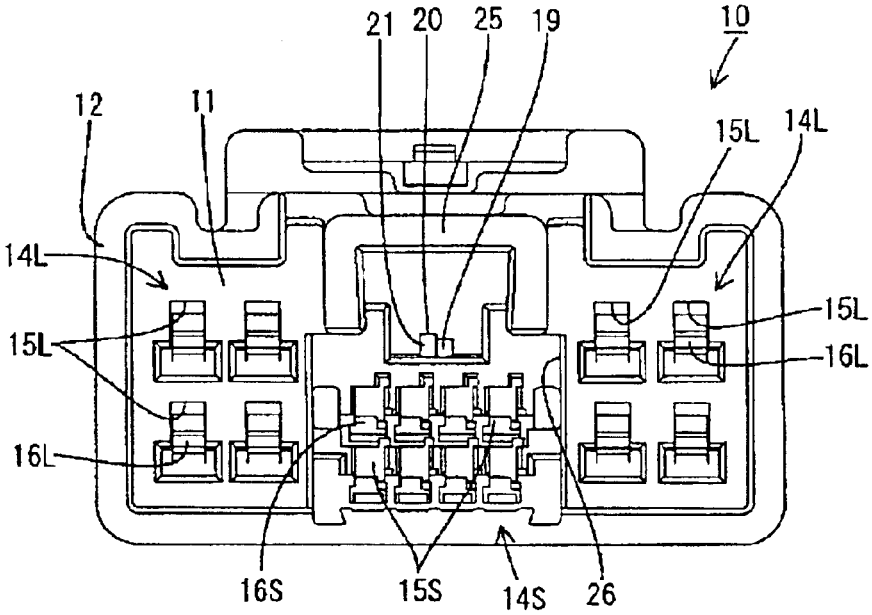
FIG. 6 is a front view of the male housing.

15. A connector, comprising:

a first housing (10) with first terminal fittings (17);

a moving member (30) mounted to the first housing (10) for movement between a first position (FIGS. 2; 4) and a second position (FIG. 5);

a second housing (40) connectable with the first housing (10) and configured for moving the moving member (30) from the first position (FIGS. 2; 4) to the second position (FIG. 5) as the first and second housings (10; 40) are connected, second terminal fittings (44) in the second housing (40) and being connected to the first terminal fittings (17) as the first and second housings (10; 40) are connected, connection of the first and second terminal fittings (17; 44) creating a connection resistance (Rc);

inertial locking means (51) in the first and second housings (10, 40) for creating a resistance force (Ra) during connection of the housings (10, 40) and for canceling resistance when a resistance canceling force (F) exceeding the resistance force (Ra) is applied to the first and second housings (10; 40); and resistance creating means (52) in the first housing (10) and the moving member (30) for creating a resistance force (Rb) against a movement of the moving member (30) toward the second position and for canceling resistance when a resistance canceling force (F) exceeding the resistance force (Rb) created by the resistance creating means (52) is given;

wherein the inertial locking means (51) and the resistance creating means (52) are configured to cancel peaks in their respective resistances (Ra; Rb) substantially simultaneously and before the first and second terminal fittings (17; 44) create the connection resistance (Rc).

16. The connector of claim 15, wherein a sum of the resistances of the inertial locking means (51) and the resistance creating means (52) exceeds the connection resistance (Rc).

17. The connector of claim 16, wherein the resistance creating means (52) comprises a resistance arm (36) on the moving member (30) and an abutting surface (21) on the first housing (10).

18. A connector, comprising:

a first housing (10) with first terminal fittings (17);

a moving member (30) mounted to the first housing (10) for movement between a first position (FIGS. 2; 4) and a second position (FIG. 5);

a second housing (40) connectable with the first housing (10) and configured for moving the moving member (30) from the first position (FIGS. 2; 4) to the second position (FIG. 5) as the first and second housings (10; 40) are connected, second terminal fittings (44) in the second housing (40) and being connected to the first terminal fittings (17) as the first and second housings (10; 40) are connected, connection of the first and second terminal fittings (17; 44) creating a connection resistance (Rc);

inertial locking means (51) in the first and second housings (10, 40) for creating a resistance force (Ra) during connection of the housings (10, 40) and for canceling resistance in response to a force exceeding the resistance force (Ra); and resistance creating means (52) in the first housing (10) and the moving member (30) for creating a resistance force (Rb) against a movement of the moving member (30) toward the second position and for canceling resistance in response to a force exceeding the resistance force (Rb);

wherein the inertial locking means (51) and the resistance creating means (52) are configured such that a sum of their respective resistances (Ra; Rb) exceed the connection resistance (Rc) at a point during a connection process before the first and second terminal fittings (17; 44) create the connection resistance (Rc).

19. The connector of claim 18, wherein the inertial locking means (51) and the resistance creating means (52) reach peaks of their respective resistances (Ra; Rb) substantially simultaneously.

20. The connector of claim 19, wherein the resistance creating means (52) comprises a resistance arm (36) on the moving member (30) and an abutting surface (21) on the first housing (10).

* * * * *